US008292403B2

(12) United States Patent
Iwata

(10) Patent No.: US 8,292,403 B2
(45) **Date of Patent: *Oct. 23, 2012**

(54) DROPLET DISCHARGE DEVICE

(75) Inventor: Yuji Iwata, Suwa (JP)

(73) Assignee: Seiko Epson Corporation (JP)

( * ) Notice: Subject to any disclaimer, the term of this patent is extended or adjusted under 35 U.S.C. 154(b) by 405 days.

This patent is subject to a terminal disclaimer.

(21) Appl. No.: 12/481,639

(22) Filed: Jun. 10, 2009

(65) Prior Publication Data

US 2009/0244192 A1 Oct. 1, 2009

Related U.S. Application Data

(62) Division of application No. 11/555,803, filed on Nov. 2, 2006.

(30) Foreign Application Priority Data

Nov. 25, 2005 (JP) ..... 2005-339774

(51) Int. Cl.
*B41J 2/14* (2006.01)

(52) U.S. Cl. ..... 347/47; 347/20; 347/18

(58) Field of Classification Search ..... 347/20, 347/44, 47
See application file for complete search history.

(56) References Cited

U.S. PATENT DOCUMENTS

| | | | | |
|---|---|---|---|---|
| 5,896,155 | A | 4/1999 | Lebens et al. | |
| 6,206,499 | B1 * | 3/2001 | Iijima et al. | 347/33 |
| 6,561,625 | B2 | 5/2003 | Maeng et al. | |
| 6,868,605 | B2 | 3/2005 | Maeng et al. | |
| 6,908,045 | B2 | 6/2005 | Shimoda et al. | |
| 7,395,976 | B2 | 7/2008 | Shimoda et al. | |
| 7,637,597 | B2 * | 12/2009 | Iwata | 347/56 |
| 7,883,176 | B2 * | 2/2011 | Iwata | 347/33 |
| 2002/0030715 | A1 * | 3/2002 | Takata et al. | 347/37 |
| 2008/0118629 | A1 | 5/2008 | Shimoda et al. | |

FOREIGN PATENT DOCUMENTS

| | | |
|---|---|---|
| CN | 1568106 | 1/2005 |
| JP | 09-164701 | 6/1997 |
| JP | 2002-200757 | 7/2002 |
| JP | 2002-254663 | 9/2002 |
| JP | 2003-019790 | 1/2003 |
| JP | 2005-118750 | 5/2005 |
| KR | 20-1987-00003696 | 3/1987 |

* cited by examiner

*Primary Examiner* — Julian Huffman
*Assistant Examiner* — Sharon A Polk
(74) *Attorney, Agent, or Firm* — Harness, Dickey & Pierce, P.L.C.

(57) ABSTRACT

A droplet discharge device includes an inkjet head including a nozzle plate having a nozzle, the inkjet head aligned so that a droplet of a function liquid discharged from the nozzle is placed on a surface of a target, a heater applying heat to the function liquid at the inkjet head, and an insulating member having an opening corresponding to the nozzle, the insulating member positioned between the target and the nozzle plate so as to prevent heat transmission from the inkjet head to the target.

3 Claims, 2 Drawing Sheets

DROPLET DISCHARGE DEVICE

This application is a divisional of U.S. patent application Ser. No. 11/555,803 filed on Nov. 2, 2006. This application claims the benefit of Japanese Patent Application No. 2005-339774 filed Nov. 25, 2005. The disclosures of the above applications are incorporated herein by reference.

BACKGROUND

1. Technical Field

The present invention relates to a droplet discharge device, in particular, a droplet discharge device that is suitable for discharging a function liquid having a temperature dependency in viscosity thereof.

2. Related Art

In order to discharge a fluid with high viscosity from an inkjet head, a method to heat the inkjet head and ink is known as disclosed in FIG. 4 of JP-A-2003-19790.

According to related art, even if an inkjet head is heated, the heat of the inkjet head is emitted from a nozzle plate and drawn by a target. Consequently, the temperature of a fluid in the inkjet head may decrease. When it occurs, viscosity of a function liquid goes up before the function liquid is discharged from nozzles. As a result, a volume of a droplet of the function liquid discharged from the nozzles at one time may be reduced.

SUMMARY

An advantage of the invention is to provide a droplet discharge device having an inkjet head in which the temperature of a function liquid is prevented from being decreased.

A droplet discharge device according to an aspect of the invention includes: an inkjet head including a nozzle plate having a nozzle, the inkjet head aligned so that a droplet of a function liquid discharged from the nozzle is placed on a surface of a target; a heater applying heat to the function liquid at the inkjet head; and an insulating member having an opening corresponding to the nozzle, the insulating member positioned between the target and the nozzle plate so as to prevent heat transmission from the inkjet head to the target.

According to the characteristics above, the heat of the inkjet head is hard to be emitted from a surface of the nozzle plate because the insulating member is positioned between the nozzle plate and the target.

According to an aspect of the invention, the droplet discharge device further includes a unit to move at least one of the insulating member and the inkjet head relative to each other so as to expose the nozzle plate.

According to the characteristic above, the nozzle plate is exposed, and thus the droplet discharge device that can perform recovering operations is obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
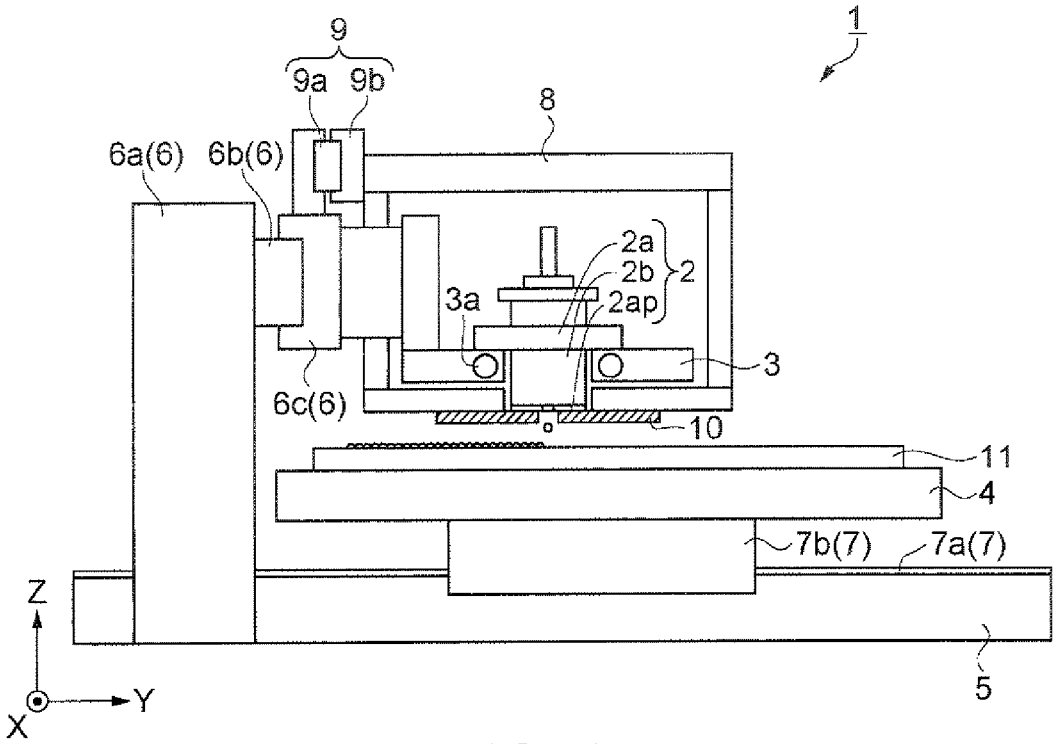
FIG. 1 is a schematic diagram showing a droplet discharge device according to an embodiment of the invention.

A droplet discharge device 1 shown in FIG. 1 includes an inkjet head 2, a carriage 3 to hold the inkjet head 2, a heater 3*a*, a stage 4, a ground stage 5, a first position control unit 6, a second position control unit 7, an insulating unit 8, a joint 9, and an insulating member 10. The first position control unit 6 here includes a support portion 6*a*, a guide rail 6*b* provided on the support portion 6*a*, and a slider 6*c* that moves in the plus or minus direction of the X-axis direction along the guide rail 6*b*. Then, the second position control unit 7 includes a guide rail 7*a* provided on the ground stage 5 and a slider 7*b* that moves in the plus or minus direction of the Y-axis direction along the guide rail 7*a*.

The carriage 3 is secured to the slider 6*c* of the first position control unit 6 via a connector. Therefore, the carriage 3 can move in the plus or minus direction of the X-axis direction with the slider 6*c* of the first position control unit. As it will be describe later, the carriage 3 includes an opening to define the position of the inkjet head 2. Further, the heater 3*a* to heat a function liquid in the inkjet head 2 is positioned inside of the carriage 3.

The stage 4 is secured to the slider 7*b* of the second position control unit 7. Therefore, the stage 4 can move in the plus or minus direction of the Y-axis direction with the slider 7*b* of the second position control unit. The stage 4 includes a surface to locate a target 11 on which droplets will be placed. In addition, the surface has a hole to fix the target 11 by suction.

The inkjet head 2 includes a substrate portion 2*a* and a convex portion 2*b* protruding from the substrate portion 2*a*. The bottom surface of the convex portion 2*b* is composed of a nozzle plate 2*ap*. Further, the convex portion 2*b* has outer sides practically perpendicular to the surface of the nozzle plate 2*ap*. The outer sides here are formed by four planes defining the side faces of the convex portion 2*b*.

The nozzle plate 2*ap* has a plurality of nozzles. Each of the plurality of nozzles has a predetermined diameter and is located on a predetermined position on the nozzle plate 2*ap*. The function liquid is discharged from each of the plurality of nozzles as a droplet. The position of the inkjet head 2 here is defined by the carriage 3 so that droplets discharged from the plurality of nozzles are placed on the surface of the target 11 on the stage 4. Specifically, the inkjet head 2 is aligned so that the plurality of nozzles face the target. More specifically, the convex portion 2*b* penetrates through the opening of the carriage 3 so that the nozzle plate 2*ap* can face the stage 4. Then, the areas around the substrate portion 2*a* and around the opening of the carriage 3 are bonded each other.

The heater 3*a* is embedded in the carriage 3. The heater 3*a* applies heat to the function liquid inside of the inkjet head 2. The heat that the heater 3 generates is transmitted to the inside of the inkjet head 2 mainly through the outer sides of the convex portion 2*b*.

The insulating unit 8 prevents heat emission of the inkjet head 2. In this embodiment, the insulating unit 8 has such a shape as to cover the carriage 3 holding the inkjet head 2. However, an edge of the insulating unit 8 in the X-axis direction is opened so as to perform recovery operations that will be described later. The insulating unit 8 described above is joined to the slider 6*c* of the first position control unit 6 through the joint 9 that will be described later. Therefore, the insulating unit 8 moves in the X-axis direction along with the inkjet head 2.

The insulating member 10 is secured to the bottom of the insulating unit 8. Further, the insulating member 10 is positioned between the inkjet head 2 and the target 11 so as to prevent heat transmission from the inkjet head 2 to the target 11. Specifically, the insulating member 10 covers the nozzle plate 2*ap* except for the plurality of nozzles. As described above, because any of the plurality of nozzles are not covered by the insulating member 10, a droplet discharge from these plurality of nozzles is not obstructed either with or without the insulating member 10. In addition, the insulating unit 8 and the insulating member 10 described above are made of an inorganic fiber containing silica and alumina. However, the insulating unit 8 and the insulating member 10 can be made of glass wool, plastic foam or ceramics instead of the inorganic fiber as above. Further, the insulating unit 8 and the insulating member 10 can be made of a different material from each other.

The joint 9 includes a guide rail 9*a* whose position is secured to the carriage 3 and a slider 9*b* that moves in the plus or minus direction of the X-axis direction along the guide rail 9*a*. Here, the insulating unit 8 described above is joined to the slider 9*b* of the joint 9. Therefore, the insulating unit 8 can move in the plus or minus direction of the X-axis direction along with the slider 9*b*. Further, because of such a function of the joint 9, the insulating unit 8 can move in the X-axis direction relative to the inkjet head 2.

Figure 3:
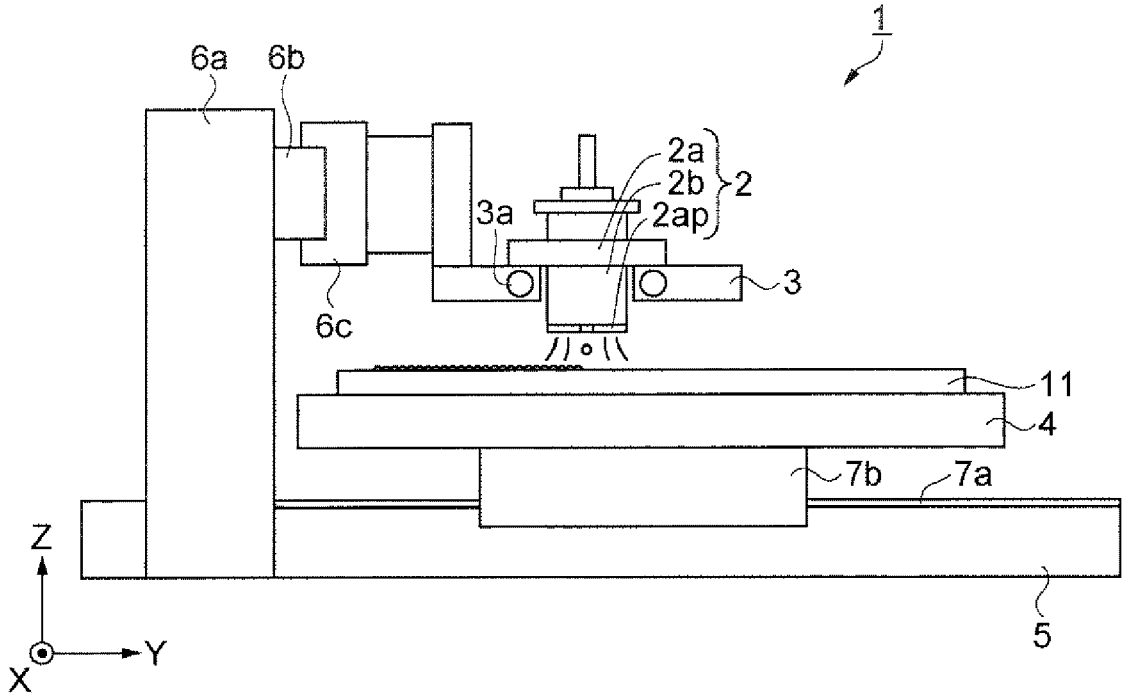
FIG. 3 is a schematic diagram showing a droplet discharge device without an insulating member and an insulating unit.

FIG. 3 shows a case where the insulating unit 8 and the insulating member 10 are removed from the droplet discharge device 1 for comparison. The distance between the surface of the nozzle plate 2*ap* of the droplet discharge device 1 and the surface of the target 11 is about 300 μm. Here, the nozzle plate 2*ap* is made of aluminum. Therefore, thermal conductivity of the nozzle plate 2*ap* is relatively high. Further, because the distance between the nozzle plate 2*ap* and the surface of the target 11 is relatively short, the heat of the inkjet head 2 is easily drawn from the surface of the nozzle plate 2*ap* by the target 11 through the air. Accordingly, in a case without the insulating member 10, even if the heater 3*a* heats the inkjet head 2, the temperature inside of the inkjet head 2 decreases. Consequently, the temperature of the function liquid inside of the inkjet head 2 decreases. In addition, when the target 11 is made of a substance having relatively high linear expansion coefficient, the target 11 has partial thermal expansion by heat transmission from the inkjet head 2. As a result, the target 11 may be buckled.

However, in the embodiment, the insulating member 10 is positioned between the nozzle plate 2*ap* and the target 11 as shown in FIG. 1. Therefore, the heat of the inkjet head 2 is not emitted and the temperature of the inkjet head 2 is thus maintained. As a result, viscosity of the function liquid before discharging is prevented from increasing. Further, because the heat is not transmitted to the target 11, the partial thermal expansion of the target 11 is prevented. As a result, the target 11 is prevented from buckling.

The function liquid here is a fluid that can be discharged from the inkjet head as droplets. The viscosity of the function liquid when the function liquid is discharged is preferably within a range from 1 mPa·s to 25 mPa·s inclusive. If the viscosity is 1 mPa·s or more, the periphery of the nozzles is hardly contaminated with the function liquid when droplets of the function liquid are discharged. Meanwhile, if the viscosity is 25 mPa·s or less, the possibility of the clogging of the nozzles is reduced, thereby a smooth droplet discharge can be achieved. The function liquid can be water-based or oil-based. Further, as long as the function liquid is a fluid as a whole, it may contain a solid matter.

The function liquid of the embodiment contains a liquid crystal material. The viscosity of the liquid crystal material has a temperature characteristic decreasing along with a temperature from low to high. Therefore, the viscosity of the function liquid has a similar temperature characteristic. For example, the viscosity of the function liquid in the embodiment is 50 mPa·s at room temperature of 25 degrees centigrade, and 15 mPa·s at 70 degrees centigrade.

In the embodiment, the function liquid in the cavity of the inkjet head 2 is heated by the heater 3*a*. Further, because the insulating member 10 is positioned between the nozzle plate 2*ap* and the target 11, the heat of the inkjet head 2 is hard to be emitted. Thus the temperature of the droplet in the cavity is hard to decrease. In the embodiment, the temperature of the function liquid in the cavity is maintained so that the viscosity of the function liquid is maintained to be suitable for being discharged as droplets.

When droplets are discharged from the nozzles continuously, the function liquid may remain on the inner surface of the nozzles because a small amount of the function liquid inside of the nozzles loses fluidity. In addition, the vicinity of the nozzles may be contaminated by the function liquid. These phenomena cause failures of the droplet discharge. Specifically, a flying path of a droplet after being discharged from a nozzle is deviated more than allowable, or the discharged volume of one droplet is deviated from the design value. To solve such failures, the recovering operations of the inkjet head 2 are performed.

Figure 2:
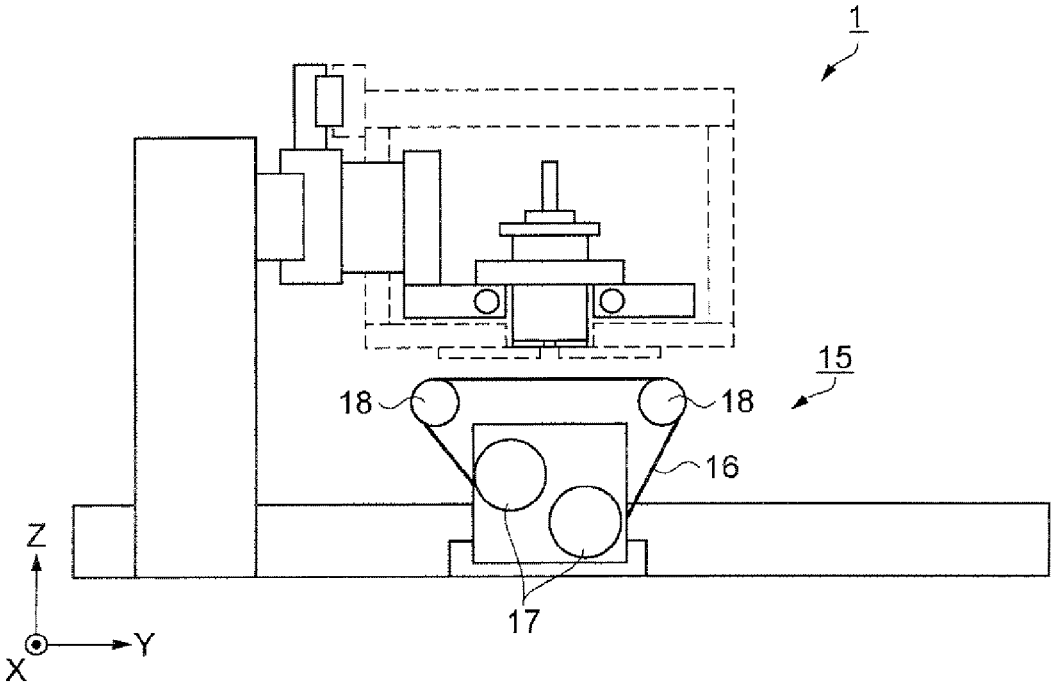
FIG. 2 is a schematic diagram showing a droplet discharge device according to the embodiment of the invention.

One of the recovering operations is flushing of droplets from the nozzles. Further, another one of the recovering operations is a wiping treatment on the nozzle plate 2*ap*. The wiping treatment is performed by a wiping unit 15 as shown in FIG. 2. The wiping unit 15 shown in FIG. 2 includes a nonwoven fabric 16 in a tape-like shape, a pair of reels 17 composed of one reel to reel out the nonwoven fabric 16 and the other reel to reel in the nonwoven fabric 16, and a pair of rollers 18 defining a route of the nonwoven fabric 16 between the pair of reels 17. The pair of rollers 18 supports the nonwoven fabric 16 therebetween so that the nonwoven fabric 16 can face the nozzle plate 2*ap*.

When the recovering operations are performed, at least one of the insulating unit 8 and the inkjet head 2 is moved relative to each other so that the nozzle plate 2*ap* is completely exposed from the insulating member 10. Specifically, by moving the insulating unit 8 in the X-axis direction through the joint 9, the surface of the nozzle plate 2*ap* is exposed from the insulating member 10. Further, the inkjet head 2 is moved in the X-axis direction by the first position control unit 6 so that the nozzle plate 2*ap* and the wiping unit 15 can face each other. Then, after adjusting the height of the wiping unit 15 so that the nozzle plate 2*ap* contacts with the nonwoven fabric 16, the whole of the nozzle plate 2*ap* is wiped off by the nonwoven fabric 16 reeled out from one reel to the other reel between the pair of reels 17. According to such a structure, the function liquid adhering to the vicinity of the nozzles is removed so as to solve the failures of the droplet discharge from the nozzles.

As described above, the function liquid of the embodiment contains a liquid crystal material as a functional material. However, the function liquid may contain other functional materials instead of the liquid crystal material. Specifically, the function liquid may contain an organic electroluminescent material, a resin material for a color filter, or a resin material for a micro lens. In any cases, even if the function liquid is not suitable for discharging from the inkjet head at room temperature, it can be placed on the surface of the target 11 by using the droplet discharge device 1 as long as the function liquid has the viscosity that may decrease along the temperature rising before the function liquid is discharged.

Further, when the droplet discharge device 1 is used, the concentration of a solvent to provide fluidity to the functional material in the function liquid can be lower. In addition, when the droplet discharge device 1 is used, the functional material (a liquid crystal material, for example) to be placed on a target can be the function liquid.

What is claimed is:

1. A droplet discharge device, comprising:

a stage to locate a target;

an inkjet head including a nozzle plate having a nozzle, the inkjet head being aligned so that a droplet of a function liquid discharged from the nozzle is placed on a surface of the target;

a carriage holding the inkjet head;

a heater applying heat to the function liquid at the inkjet head;

an insulating unit preventing heat emission of the inkjet head, the insulating unit covering the carriage; and a position control unit that moves at least one of the insulating unit and the inkjet head, the insulating unit being joined to the position control unit.

2. The droplet discharge device according to the claim 1, wherein, the insulating unit and the inkjet head are relatively moved by the position control unit so as to expose the nozzle plate.

3. The droplet discharge device according to claim 1, wherein the insulating unit does not cover the nozzle.

* * * * *